US005564787A

United States Patent [19]

Barile

[11] Patent Number: 5,564,787

[45] Date of Patent: Oct. 15, 1996

[54] CHAIR FRAME AND ASSOCIATED CHAIR FRAMING MATERIAL

[75] Inventor: Peter Barile, Morristown, Tenn.

[73] Assignee: Shelby Williams Industries, Inc., Morristown, Tenn.

[21] Appl. No.: 358,781

[22] Filed: Nov. 8, 1994

[51] Int. Cl.[6] ..... A47C 7/02

[52] U.S. Cl. ..... 297/452.18; 297/452.2; 297/445.1

[58] Field of Search ..... 297/452.2, 452.18, 297/452.19, 445, 449, 451, 445.1, 449.1; 52/738, 737, 720, 731.1, 731.5, 731.4, 732.3

[56] References Cited

U.S. PATENT DOCUMENTS

| | | | |
|---|---|---|---|
| 815,617 | 3/1906 | Maeser | 52/737 |
| 1,280,725 | 10/1918 | Havemeyer | 52/738 |
| 2,401,542 | 6/1946 | Booth | 297/452.2 X |
| 2,963,131 | 12/1960 | Brockway | 52/731.5 X |
| 3,041,110 | 6/1962 | King et al. | 297/451 |
| 3,081,795 | 3/1963 | Lesser | 138/177 |
| 3,104,085 | 9/1963 | Sklandany | 248/119 |
| 3,159,428 | 12/1964 | Schier | 297/452 |
| 3,219,368 | 11/1965 | Crumpler | 285/285 |
| 3,246,928 | 4/1966 | Haynes et al. | 297/239 |
| 3,875,699 | 4/1975 | Lamarre | 47/46 |
| 3,941,157 | 3/1976 | Barnett | 138/115 |
| 4,069,638 | 1/1978 | Hasselqvist et al. | 52/738 X |
| 4,123,105 | 10/1978 | Frey et al. | 297/451 |
| 4,280,269 | 7/1981 | Marini | 29/526 R |
| 4,410,012 | 10/1983 | Redding | 138/121 |
| 4,426,114 | 1/1984 | Kehl et al. | 297/232 |
| 4,676,553 | 6/1987 | Lange | 297/446 |
| 4,850,647 | 7/1989 | Engel | 297/446 |
| 5,269,619 | 12/1993 | Warkus et al. | 52/738 X |
| 5,412,860 | 5/1995 | Miyauchi et al. | 297/452.2 X |

*Primary Examiner*—Milton Nelson, Jr.
*Attorney, Agent, or Firm*—Pitts & Brittian, P.C.

[57] ABSTRACT

A chair frame and associated chair framing material. The chair frame (10) includes an upper frame portion (12) for supporting a seat (14) and a plurality of leg members (22, 24). The chair frame (10) is fabricated of elongated bar material (26) defining a substantially rectangular cross-section with corners which define expanded areas such that reenforcing ribs (28) are provided along the length of the elongated bar material (26).

2 Claims, 2 Drawing Sheets

CHAIR FRAME AND ASSOCIATED CHAIR FRAMING MATERIAL

TECHNICAL FIELD

This invention relates to a chair frame and associated chair framing material. In this particular invention the chair frame is fabricated from an elongated bar material having a substantially rectangular cross-section with reinforcing corner ribs defined at corners of the bar material.

BACKGROUND ART

Chair frames which are fabricated out of tubular materials are known in the art. For example, such chair frames are disclosed in U.S. Patent Nos. 3,081,795; 3,159,428; 3,246,928; 4,123,105; 4,280,269; 4,426,114; and 4,676,553. Whereas such chair frames tend to be lightweight and inexpensive to manufacture, they tend to lack strength and durability, and tend to lack the aesthetic qualities which are desirable in furniture. Indeed, where strength and durability of the tubular framing material is increased, the material typically becomes difficult to cut and shape, consequently increasing the cost of manufacture.

Therefore, it is an object of the present invention to provide a chair frame and chair framing material which are lightweight, yet strong and durable.

It is another object of the present invention to provide a chair framing material which is strong and durable, yet can be easily cut to desired lengths and/or bent into desired configurations.

Yet another object of the present invention is to provide a chair frame and chair framing material which is aesthetically pleasing.

Still another object of the present invention is to provide a chair frame and chair framing material which are inexpensive, yet durable.

DISCLOSURE OF THE INVENTION

Other objects and advantages will be accomplished by the present invention which provides a chair frame and associated chair framing material. The chair frame includes an upper frame portion for supporting a seat and includes a plurality of leg members. The upper frame and said leg members are fabricated of the framing material of the present invention which comprises an elongated bar material of extruded aluminum defining a substantially rectangular cross-section with corners which define expanded areas such that reenforcing corner ribs are provided along the length of the elongated bar material. Further, the elongated bar material, in certain embodiments, defines an opening therethrough to reduce frame weight.

BRIEF DESCRIPTION OF THE DRAWINGS

The above mentioned features of the invention will be more clearly understood from the following detailed description of the invention read together with the drawings in which:

FIG. 4B illustrates a side elevation view of a further alternate embodiment of the chair framing material of the present invention.

BEST MODE FOR CARRYING OUT THE INVENTION

Figure 1:
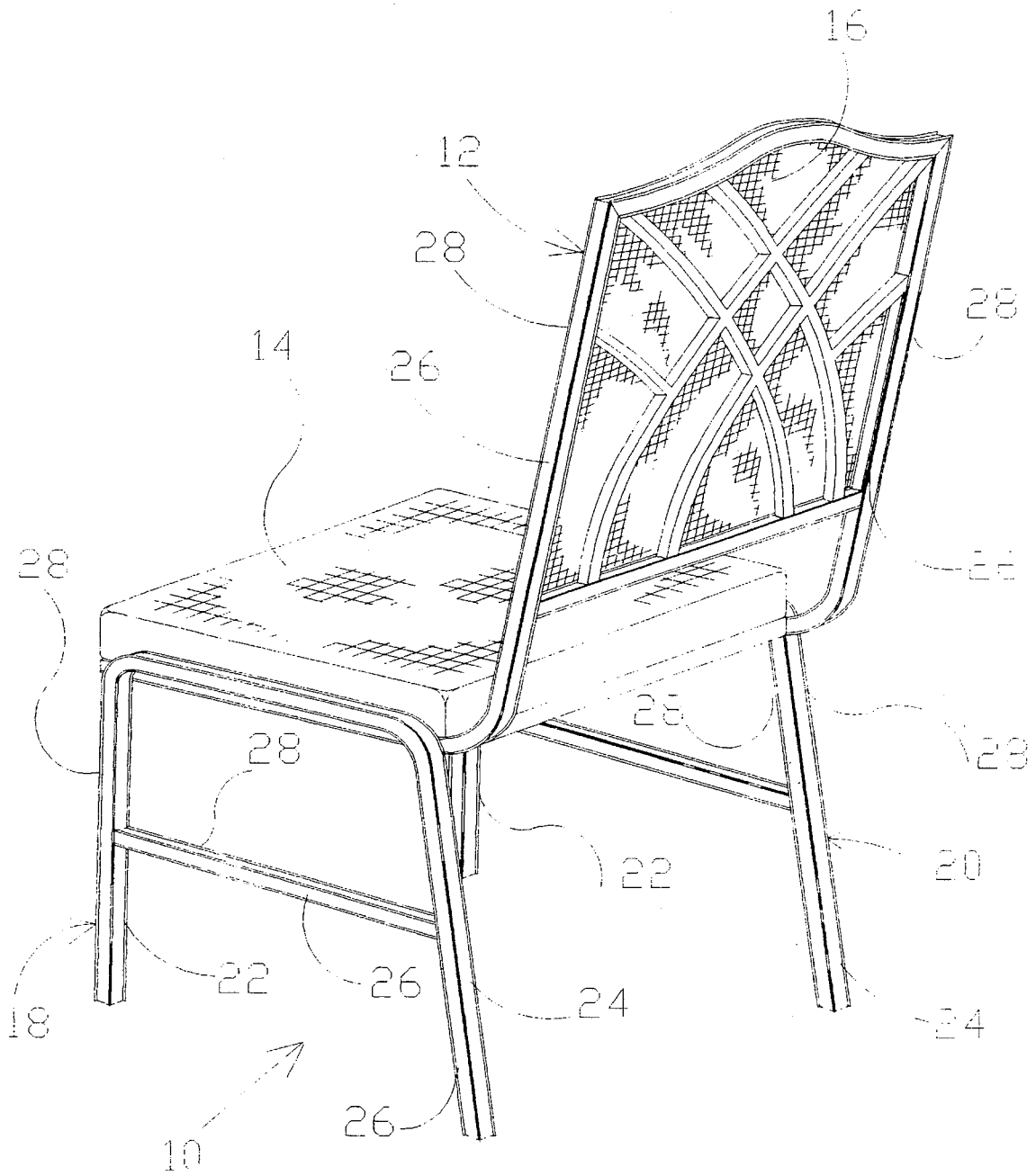
FIG. 1 illustrates a perspective view of a chair frame of the present invention which is fabricated on the chair framing material of the present invention.

A chair frame incorporating various features of the present invention is illustrated generally at 10 in FIG. 1. In the preferred illustrated embodiment, the chair frame 10 includes an upper frame portion 12 for supporting a seat 14 and a seat back 16. The frame 10 also includes oppositely disposed leg assemblies 18 and 20 which are secured to the upper frame portion 12, with each of the leg assemblies 18 and 20 defining a front leg member 22 and a rear leg member 24. Whereas in the illustrated embodiment the leg assemblies 18 and 20 integrally form the front and rear leg members 22 and 24, it will be understood that the chair frame can include four separate leg members if desired. In this regard, the specific configuration of the chair frame which is illustrated in FIG. 1 is merely illustrative of one preferred embodiment of the frame 10. Moreover, the term "chairs" as used herein is intended to include stools, benches and other seating apparatus.

Figure 2A:
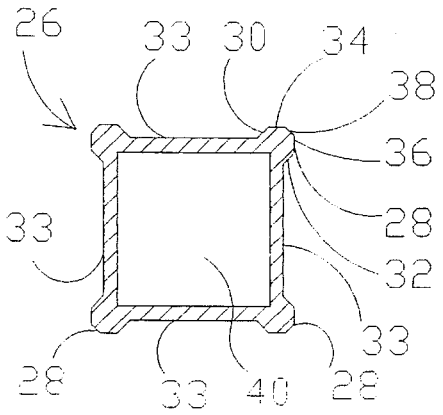
FIG. 2A illustrates an end view, in section taken at 2A—2A of FIG. 2B, of the chair framing material of the present invention.
Figure 2B:
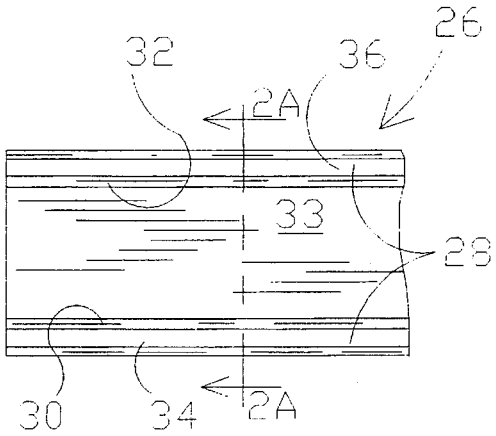
FIG. 2B illustrates a side elevation view of the chair framing material of the present invention.

The chair framing material of the present invention, from which the chair frame 10 is fabricated, comprises elongated bar material 26 which generally defines a rectangular cross-section. However, integrally formed with, and extending along the length of, the elongated bar material 26 at its four corners are expanded areas which form reenforcing corner ribs 28. As illustrated in FIG. 2A, in one preferred embodiment each of the ribs 28 defines first and second opposing, substantially parallel exterior surfaces 30 and 32 which extend at substantially 45° angles from an adjoining primary wall surface 33 of the bar material 26. Further, the ribs 28 define third and fourth exterior surfaces 34 and 36 which adjoin the first and second exterior surfaces 30 and 32, respectively, at substantially 45° angles, and converge in a rounded corner surface 38. However, the ribs 28 can define various cross-sectional configurations.

Figure 3A:
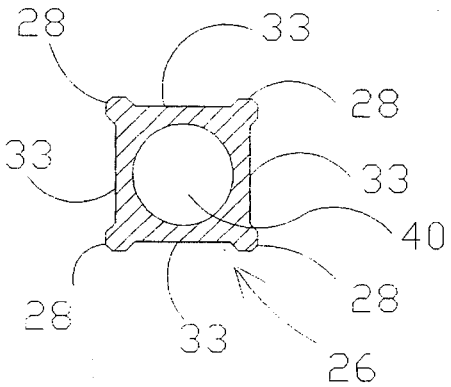
FIG. 3A illustrates an end view, in section taken at 3A—3A of FIG. 3B, of an alternate embodiment of the chair framing material of the present invention.
Figure 3B:
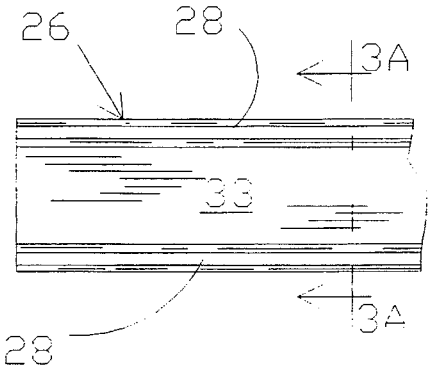
Figure 4A:
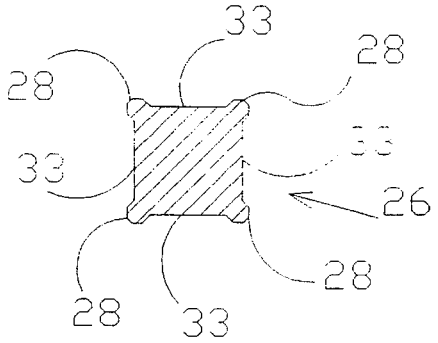
FIG. 4A illustrates a side elevation view of an alternate embodiment of the chair framing material of the present invention.
Figure 4B:
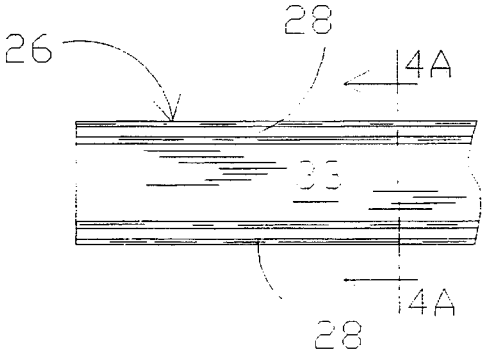
FIG. 4B illustrates an end view, in section, of a further alternate embodiment of the chair framing material of the present invention.

Whereas it is contemplated that the 26 can be solid as illustrated in FIG. 4A, in the preferred embodiment the 26 defines a hollow area 40 extending therethrough such that the bar material 26 is lightweight. In the preferred embodiment the hollow area 40 defines a rectangular cross-section, but, as illustrated in FIG. 3A, the hollow area 40 can define a circular cross-section or other geometric configurations.

The bar material 26 is preferably fabricated of aluminum which is extruded to form the desired cross-sectional configuration. Whereas extruded aluminum is relatively soft and often considered unsuitable for durable chair framing uses, the reenforcing ribs 28 serve to strengthen the bar material 26. As a result, the bar material 26 produces a strong, durable chair frame, while at the same utilizing lightweight extruded aluminum as a fabricating material. Further, the use of extruded aluminum allows the bar material 26 to be readily cut and bent into the desire configurations for forming the various components of the chair frame 10.

It will also be noted that the ribs 28 produce a decorative visual effect which is aesthetically pleasing such that the aesthetic qualities of the frame 10 are not sacrificed to achieve the desired frame strength. Moreover, the extruded aluminum material is receptive of various surface finishes, lacquers, and paints, thereby facilitating the further decoration of the chair frame 10.

In light of the above it will be recognized that the present invention provides a chair frame and associated chair framing material having great advantages over the prior art. However, while a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A Chair frame, said chair frame comprising an upper frame portion for supporting a seat and a plurality of leg members, said chair frame being fabricated of elongated bar material of extruded aluminum, said elongated bar material having an extruded configuration defining a substantially rectangular cross-section with corners defining expanded areas of substantially solid extruded aluminum such that reenforcing ribs are provided along the length of said elongated bar material.

2. A Chair frame, said chair frame comprising an upper frame portion for supporting a seat and a plurality of leg members, said chair frame being fabricated of elongated bar material of extruded aluminum, said elongated bar material having an extruded configuration defining a substantially rectangular cross-section with corners defining expanded areas of substantially solid extruded aluminum such that reenforcing ribs are provided along the length of said elongated bar material, each said reenforcing rib defining first and second opposing, substantially parallel exterior surfaces which extend at substantially 45° angles from an adjoining exterior primary wall surface of said elongated bar material and define third and fourth exterior surfaces which adjoin said first and second exterior surfaces, respectively, at substantially 45° angles, and which converge in a rounded exterior corner surface.

* * * * *